US009456711B2

(12) United States Patent
Buxkemper-Odenkirk

(10) Patent No.: US 9,456,711 B2
(45) Date of Patent: Oct. 4, 2016

(54) CURTAIN PANEL WITH FABRIC TABS AND GROMMETS

(71) Applicant: Peking Handicraft, Inc., South San Francisco, CA (US)

(72) Inventor: Maria Buxkemper-Odenkirk, McFarland, WI (US)

(73) Assignee: Peking Handicraft, Inc., South San Francisco, CA (US)

( * ) Notice: Subject to any disclaimer, the term of this patent is extended or adjusted under 35 U.S.C. 154(b) by 0 days.

(21) Appl. No.: 14/321,202

(22) Filed: Jul. 1, 2014

(65) Prior Publication Data

US 2015/0083345 A1 Mar. 26, 2015

Related U.S. Application Data

(63) Continuation-in-part of application No. 14/168,783, filed on Jan. 30, 2014, now abandoned.

(60) Provisional application No. 61/881,248, filed on Sep. 23, 2013.

(51) Int. Cl.

| | |
|---|---|
| ***A47H 13/02*** | (2006.01) |
| ***A47K 3/38*** | (2006.01) |
| ***A47H 23/10*** | (2006.01) |
| ***A47H 13/16*** | (2006.01) |
| *A47H 23/02* | (2006.01) |

(52) U.S. Cl.

CPC ..... *A47H 13/02* (2013.01); *A47H 13/16* (2013.01); *A47H 23/10* (2013.01); *A47K 3/38* (2013.01); *A47H 2023/025* (2013.01)

(58) Field of Classification Search

CPC ..... A47H 13/01; A47H 13/02; A47H 13/04; A47H 15/04; A47H 13/00; A47H 13/16

USPC ..... 160/330, 348; 59/86

See application file for complete search history.

(56) References Cited

U.S. PATENT DOCUMENTS

| | | | | | |
|---|---|---|---|---|---|
| 1,521,030 | A | * | 12/1924 | McGhee | A47H 13/02 16/87.2 |
| 1,604,686 | A | * | 10/1926 | Falkenberg | 160/348 |
| 1,828,012 | A | * | 10/1931 | Wragg | A47H 13/02 24/710.2 |
| 1,939,617 | A | * | 12/1933 | Bernhard | A47H 13/02 16/87.2 |
| 2,209,007 | A | * | 7/1940 | Stevenson | F16G 15/06 411/946 |
| D625,987 | S | * | 10/2010 | Barrese | D8/367 |
| 2007/0246174 | A1 | * | 10/2007 | Barrese | 160/330 |
| 2015/0034254 | A1 | * | 2/2015 | Moreno | 160/3 |
| 2015/0083345 | A1 | * | 3/2015 | Buxkemper-Odenkirk | A47H 13/02 160/84.04 |

FOREIGN PATENT DOCUMENTS

| | | | |
|---|---|---|---|
| FR | 418527 | * | 7/1910 |
| GB | 674441 | * | 6/1952 |

* cited by examiner

*Primary Examiner* — Blair M Johnson

(74) *Attorney, Agent, or Firm* — Venable LLP; William A. Hector

(57) ABSTRACT

A grommet glide curtain panel includes a panel with a front-facing side and a back side, a plurality of grommets each being engaged with a fabric tab, and a plurality of spaced fabric tabs attached to a top section of the back side of the panel. The fabric tab is configured to enclose a section of the D-shaped grommet to the panel and is aligned to receive a curtain rod so that the grommets can glide on said rod for easy care, opening, closing, and hanging the panel.

16 Claims, 13 Drawing Sheets

CURTAIN PANEL WITH FABRIC TABS AND GROMMETS

CROSS-REFERENCE TO RELATED APPLICATIONS

The present application is a continuation-in-part of the co-pending patent application Ser. No. 14/168,783 filed on Jan. 30, 2014, which claims the benefit of the Provisional Patent Application No. 61/881,248 filed on Sep. 23, 2013. The entire disclosure of both applications is incorporated herein by reference.

FIELD OF USE

The present disclosure relates to a curtain panel with grommets, and more particularly, to a curtain panel with a plurality of grommets attached thereto by fabric tabs to facilitate hanging, opening, and closing the curtain panel.

BACKGROUND

Typically, plain or pinch pleat panels used as window or shower curtains require extra hardware like drapery hooks, rings, or pins for installing, opening, and closing the curtains. However, drapery hooks, rings, or pins used to hang a plain or pinch pleat panel for a window are cumbersome, inconvenient, and often not applicable to the convenience of from-store-to-window offerings.

Many other home goods such as shower curtains and draperies have leveraged this type of attachment using grommets to assist consumers with the convenience of the ease of attachment. In some readymade window treatment categories, grommets are directly attached to a panel itself and are aligned to receive a curtain rod.

However, if the grommets are directly attached to the panel itself, a curtain rod must be inserted into the panel itself and the grommets are exposed from both front and back sides of the panel, which is not desirable from the aesthetic perspective. Also, the lifetime and durability of the panel can be adversely affected by directly attaching the grommets to the panel itself.

What is desirable is a new window or shower curtain panel that can be conveniently mounted, opened, and closed on a curtain rod via fabric tabs bearing grommets, that does not require all extra hardware like drapery hooks, rings, or pins for customer to install the curtain panel, that does not impact the manufacturing cost, and that does not expose the curtain rod when it was installed, opened, and closed.

SUMMARY

The present disclosure relates to a curtain panel with fabric tabs engaged with grommets that are configured to glide on a curtain rod for easy hanging, opening, and closing the panel. The present disclosure eliminates the need for extra hardware including drapery pins or hooks. Additionally, the disclosed curtain panel allows for easy and smooth hanging, opening, and closing the panel without any additional mechanism, and no part of the curtain rod can be seen when installed.

According to one aspect of the present disclosure, a curtain panel with fabric tabs and D-shaped grommets for easy care, hanging, opening, closing, and laundering of the panel is disclosed. A grommet-glide curtain panel includes a panel with a front-facing side and a back side, a plurality of grommets each being engaged with a fabric tab, and a plurality of spaced fabric tabs attached to a top section of the back side of the panel. The fabric tab is configured to enclose a section of the grommet such that each grommet is attached to the panel and is aligned to receive a curtain rod so that the grommets can glide on said rod to open and close the panel.

According to another aspect of the present disclosure, a method for manufacturing a grommet glide curtain panel with fabric tabs is disclosed. The method includes providing a panel with a front-facing side and a back side, attaching a plurality of spaced fabric tabs to a top section of the back side of the panel, and engaging a grommet with the fabric tab configured to enclose a section of the grommet such that each grommet is attached to the panel and aligned to receive a curtain rod.

The details of one or more embodiments of the present invention are set forth in the accompanying drawings and the description below. Other features, objects, and advantages of the present invention will be apparent from the description and drawings, and from the claims.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

The drawings depict various preferred embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The present disclosure relates to a curtain panel with flip tabs for easy hanging, opening, and closing the panel. An embodiment will be described below with reference to the accompanying drawings.

Figure 1A:
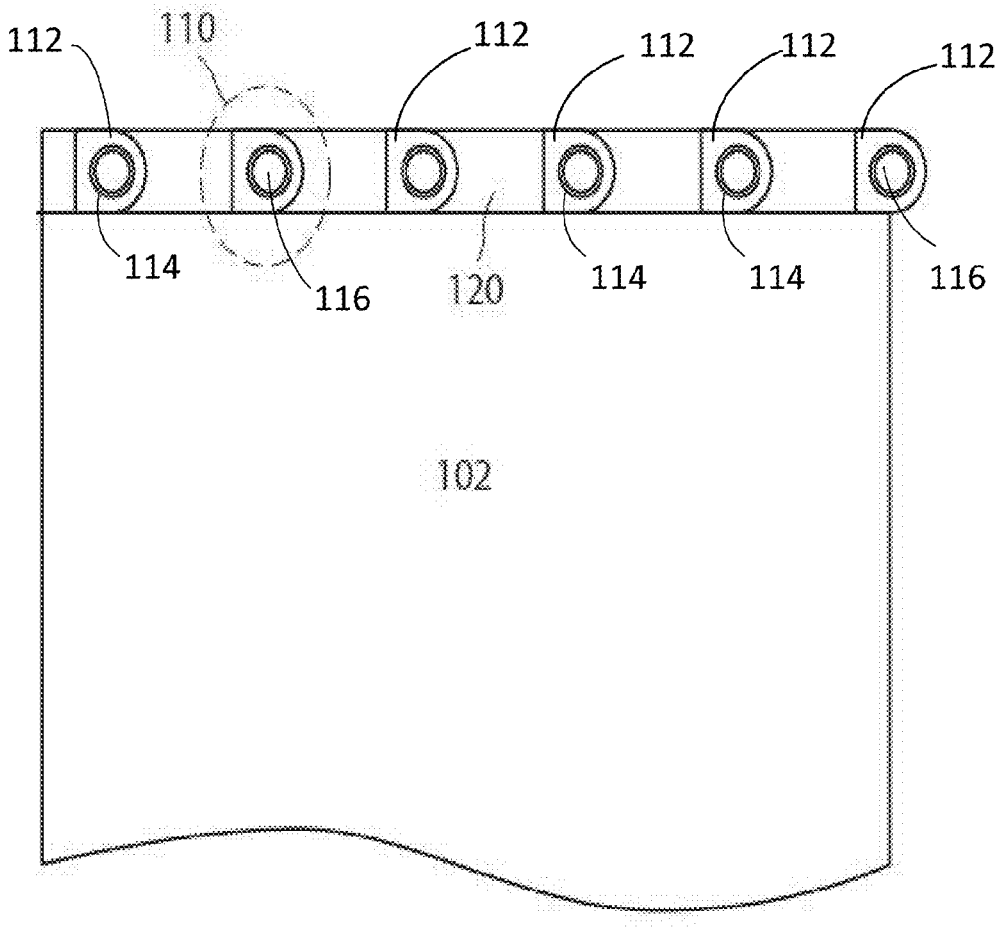
FIG. 1A illustrates a back side of a curtain panel with a plurality of flip tabs attached to a top section of the panel according to an embodiment of the present disclosure.

FIG. 1A illustrates a back side of a curtain panel where a plurality of flip tabs are attached to a top section of the panel according to an embodiment of the present disclosure. The panel 102 can be applied to a drapery or a curtain design such that the installation process of the drapery or curtain in a home would be much easier.

Referring to FIG. 1A, the panel 102 has a top section 120 disposed across the panel 102 on which a plurality of spaced flip tabs 112 are attached. The top section 120 is a portion of the panel 102 to which the plurality of flip tabs are affixed and aligned to receive a horizontal curtain rod 202 (FIG. 2A) to support the entire panel 102. The flip tab 112 is semi-circle in shape as further shown in FIGS. 2A and 2B, but the shape of the flip tab is not limited to the semi-circled shape. The flip tab 112 is generally evenly spaced across the top section 120 of the panel 102. The flip tab 112 can be formed of any flexible sheet material such as fabric, vinyl, leather, or the like, and can be made of polyester, cotton, linen, silk, or other fabric types including blends such as poly cotton, and the like. In one embodiment, the flip tab 112 is made of polyester or a combination of polyester and cotton, polyester and rayon, polyester and acetate, or all other fabric types. If the flip tab is made of fabric, it can be interlined with interlining materials including polyester, cotton, rayon, or acetate, etc. for stability and durability.

The flip tab 112 is designed to have an opening 116 formed in approximately the center portion to accommodate a grommet 114. The grommet is placed within the opening 116 of the flip tab and is affixed to the flip tab along the edge defined by the opening 116 formed within the flip tab 112. The flip tab with grommet embedded therein 110 is then attached by various known methods to the top section 120 of the panel 102. A plurality of flip tabs with grommets embedded therein are aligned to receive a curtain rod 202 as shown in FIGS. 2A and 2B such that the panel 102 can be easily mounted on the rod 202, opened, and closed smoothly.

Figure 1B:
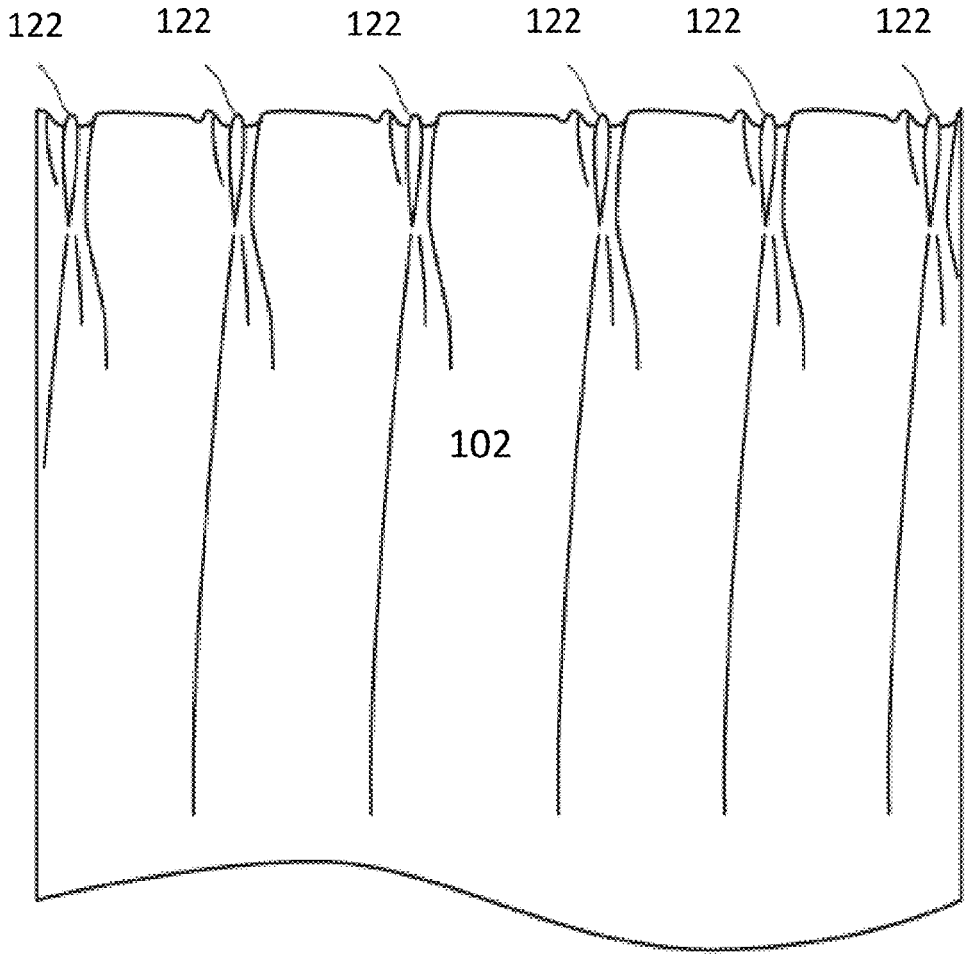
FIG. 1B illustrates a front-facing side of a curtain panel with a plurality of spaced pleats according to an embodiment of the present disclosure.

FIG. 1B illustrates a front-facing side of the curtain panel 102 where a plurality of spaced pleats 122 are formed according to one exemplary embodiment of the present disclosure. The panel 102 can be formed of any flexible sheet material similar to that of the flip tab 112, such as fabric polyester, vinyl, silk linen or the like. In one embodiment, the panel 102 can be a plain fabric with no pinch pleats formed therein. In another embodiment, the panel 102 can have a plurality of spaced pinch pleats 122 along the top section of the panel to give the panel 102 an aesthetically pleasing appearance as shown in FIGS. 1B and 2C. A buckram (not shown) is a form of a liner that can be often used as a stiffener. For the purpose of the pleats 122, a buckram can be used to hold the shape of the pleats 122 in place. Optionally, the flip tab 112 can be interlined with buckram for stability and durability.

Figure 2A:
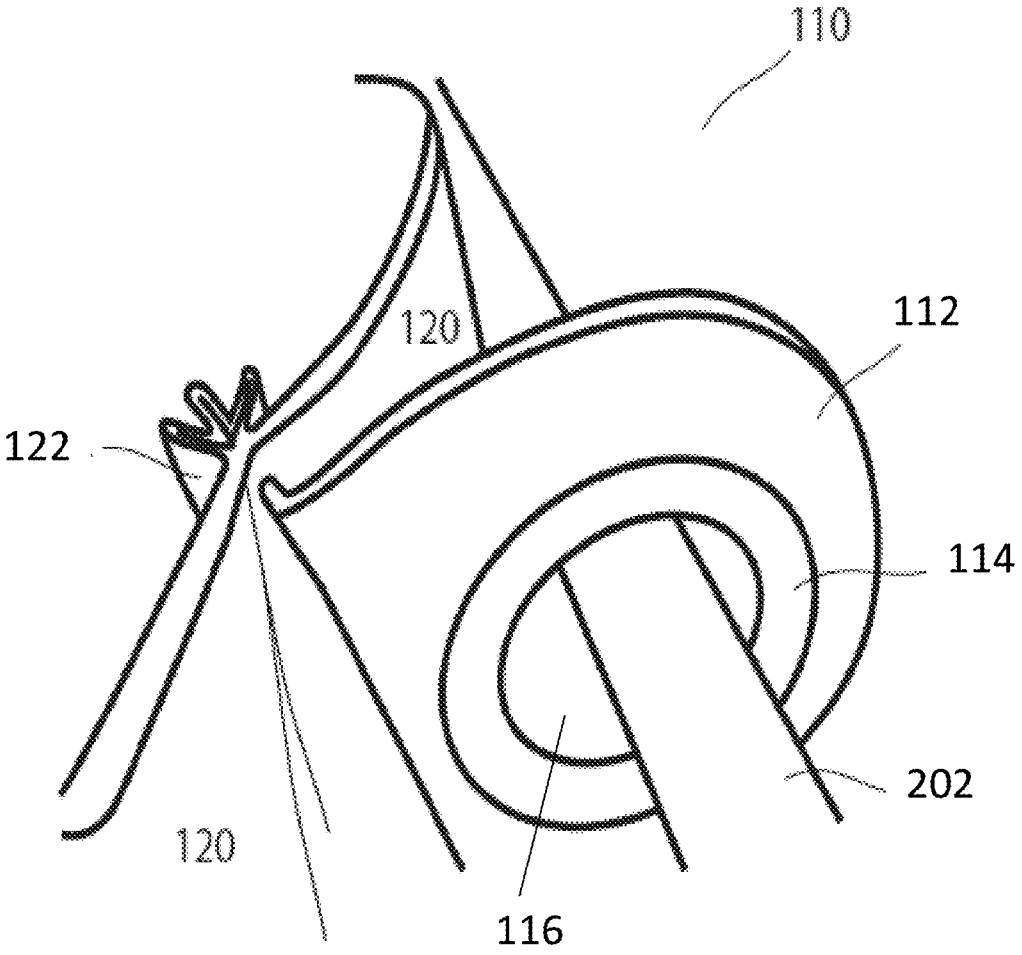
FIG. 2A illustrates a partial side view of a curtain panel with flip tabs bearing grommets therein according to an embodiment of the present disclosure.

FIG. 2A illustrates a partial side view from the back side of a curtain panel with flip tabs embedded with grommets therein according to an embodiment of the present disclosure. As described above, the pleat 122 is formed on the front-facing side of the panel 102, while the flip tab 112 is attached on the top section of the back side of the panel 102 as shown in FIG. 2A. A grommet 114 is affixed to the flip tab 112 through an opening 116 formed in approximately the center portion of the flip tab 112. The flip tab 112 is sewn or attached by other means to the back side of the panel 102 on its top section 120.

Figure 2B:
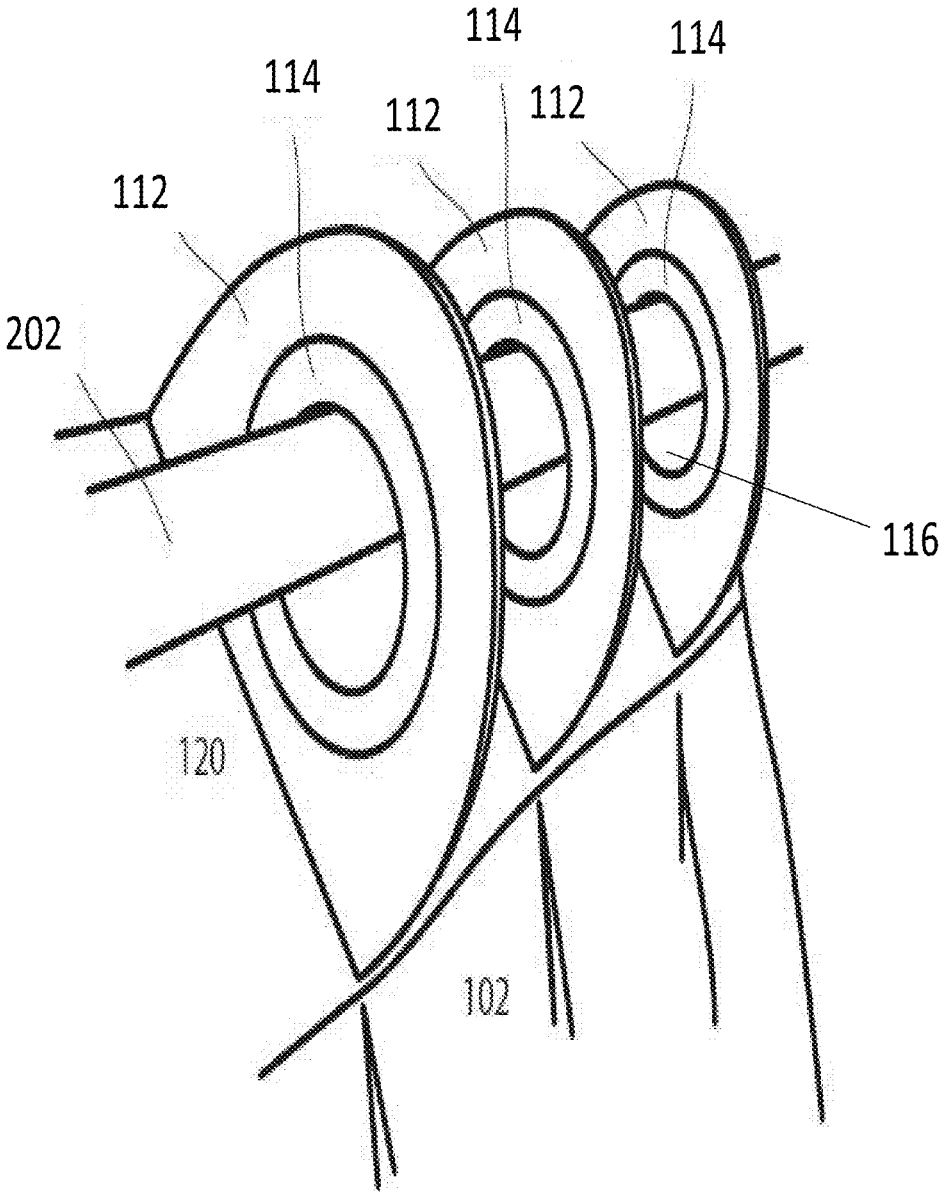
FIG. 2B illustrates a partial side view of a curtain panel with flip tabs embedded with grommets therein that are aligned to receive a rod according to an embodiment of the present disclosure.
Figure 2C:
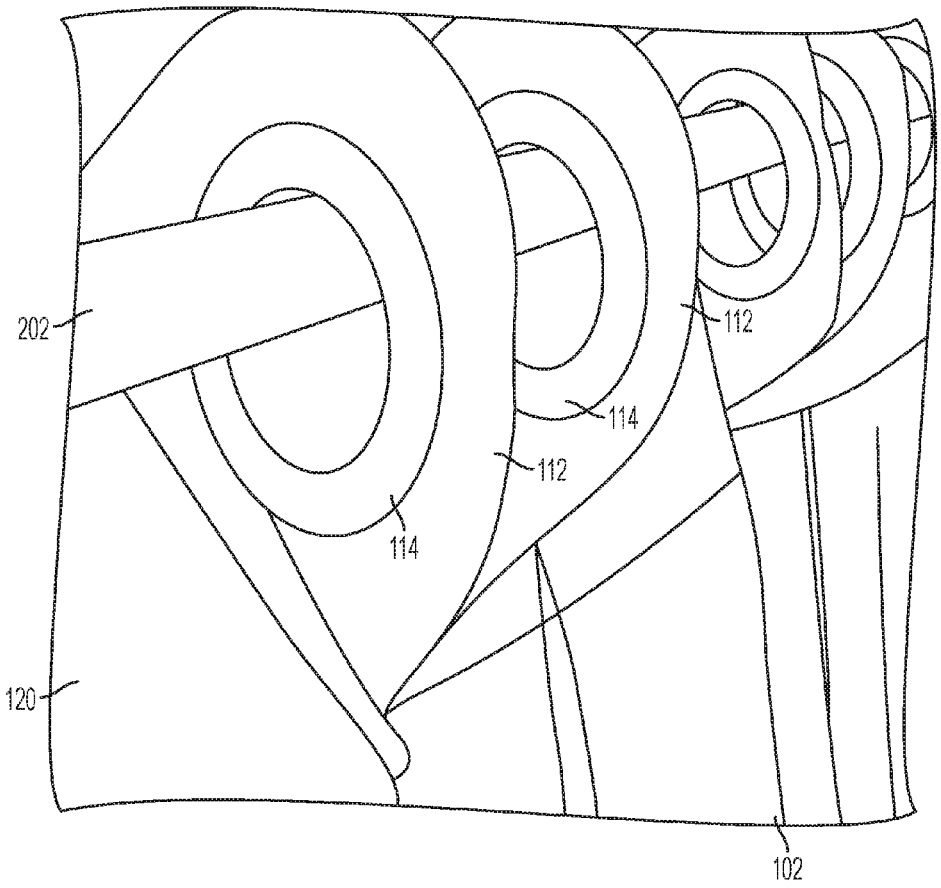
FIG. 2C is a photographic partial side view of a curtain panel with flip tabs bearing grommets therein that are aligned to receive a rod according to an embodiment of the present disclosure.

FIG. 2B illustrates a partial side view from the back side of a curtain panel with flip tabs embedded with grommets therein that are aligned to receive a curtain rod according to one exemplary embodiment of the present disclosure. Referring to FIG. 2B, the panel 102 is designed to be suspended from and movable along a horizontally extending curtain rod 202. The rod 202 can be attached to a wall or to a window frame above or in front of the window. The flip tabs 112 being embedded with the grommets 114 can be easily aligned to receive the rod 202, and thus no drapery hooks, rings, or pins are utilized to hang the panel from the rod. FIG. 2C is a photographic partial side view from the back side of the curtain panel 102 with a plurality of flip tabs 112 each being embedded with a grommet 114 therein that are aligned to receive a curtain rod 202 according to an embodiment of the present disclosure.

Referring to FIGS. 1A and 2B, the flip tabs 112 that are embedded with the grommets 114 are disposed at spaced intervals along the top section of the panel 102. The flip tabs 112 are aligned to receive a horizontal curtain rod 202 to support the panel 102. As shown in FIGS. 2B and 2C, the grommets 114 are essentially hollow rigid rings, and are used with curtain rod having a circular cross-sectional configuration. Grommets 114 are commonly made of metal, but are not specifically limited to metal. For example, grommets can be formed of plastic or other materials including resin, metal formed over plastic, or bamboo, etc.

Each grommet is placed within an opening 116 formed in each flip tab 112 as illustrated in FIGS. 1A and 2A. In one embodiment, the grommet 114 may have a circumferential channel adapted to engage the flip tab 112 along a boundary formed by the opening 116 to be attached to the flip tab. In another embodiment, the grommet 114 can be sewn to the flip tab. In either way, each grommet disposed within a flip tab eliminates the need to use extra hardware such as drapery hooks, rings, or pins to hang the panel, thereby allowing for easy installing, opening, and closing the panel.

Figure 3:
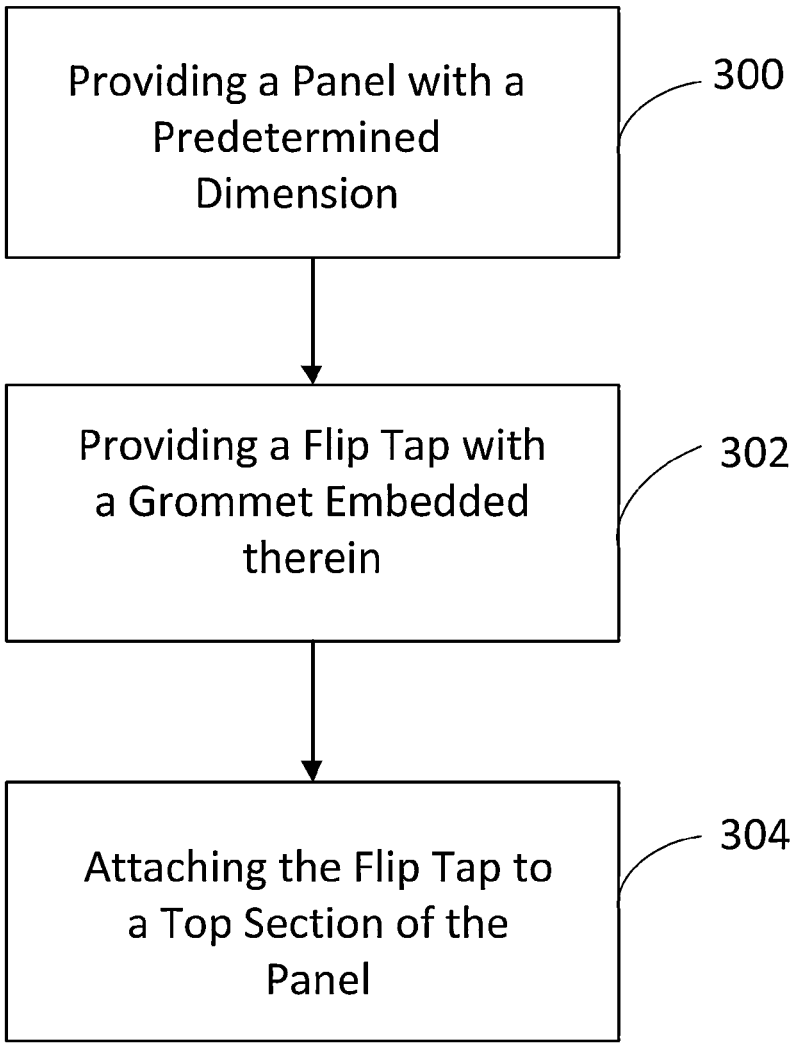
FIG. 3 is a flow chart depicting a process of manufacturing a curtain panel with flip tabs according to an embodiment of the present disclosure.

FIG. 3 is a flow chart depicting a process of manufacturing a curtain panel with flip tabs according to an embodiment of the present disclosure. The manufacturing process begins at step 300 where a curtain panel with a predetermined dimension is provided. As one exemplary embodiment, the panel 102 is about 84 inches long and 25 inches wide. However, there are many readymade panels with different width and length, the panel 102 is not limited to a specific dimension in either width or length. The panel with flip tabs as disclosed in the present disclosure can be applied to any types of curtains such as window curtains, shower curtains, or kitchen curtains. At step 302, a flip tab embedded with a grommet is provided. Each flip tab with grommet embedded therein can be attached to the top section of the panel by sewing or by other known means at step 304.

Since the grommets are not directly affixed to the panel itself, the panel does not have to be cut out to form openings to receive grommets. Since the panel itself is not perforated to receive the grommet, the durability of the panel improves. Also, the manufacturing processes can be simplified and the manufacturing cost can be reduced because pre-manufactured flip tabs can be simply affixed to the panel by sewing or by using Velcro, glue, or snapper, or by other known methods. Accordingly, it would be advantageous to provide a window treatment having a curtain panel with a plurality of flip tabs embedded with grommets because the resulting panel can be manufactured with reduced manufacturing steps and costs, and the durability of the panel improves. Also, with the above design, the curtain rod is not exposed from the front-facing side when the panel is installed, thereby providing an improved panel design from the aesthetic perspective.

The curtain panel with flip tabs works well with any standard or regular curtain rod. Since no extra hardware is needed to hang, open, or close the panel, the disclosed curtain panel eliminates the need for drapery hooks, rings, or pins and provides simplified installation, easy and convenient opening and closing of the panel. Since the disclosed curtain panel can be simply hung from the rod, no extra effort to get the hooks inserted into the right spot and no extra cost in purchasing extra hardware is incurred.

Figure 4A:
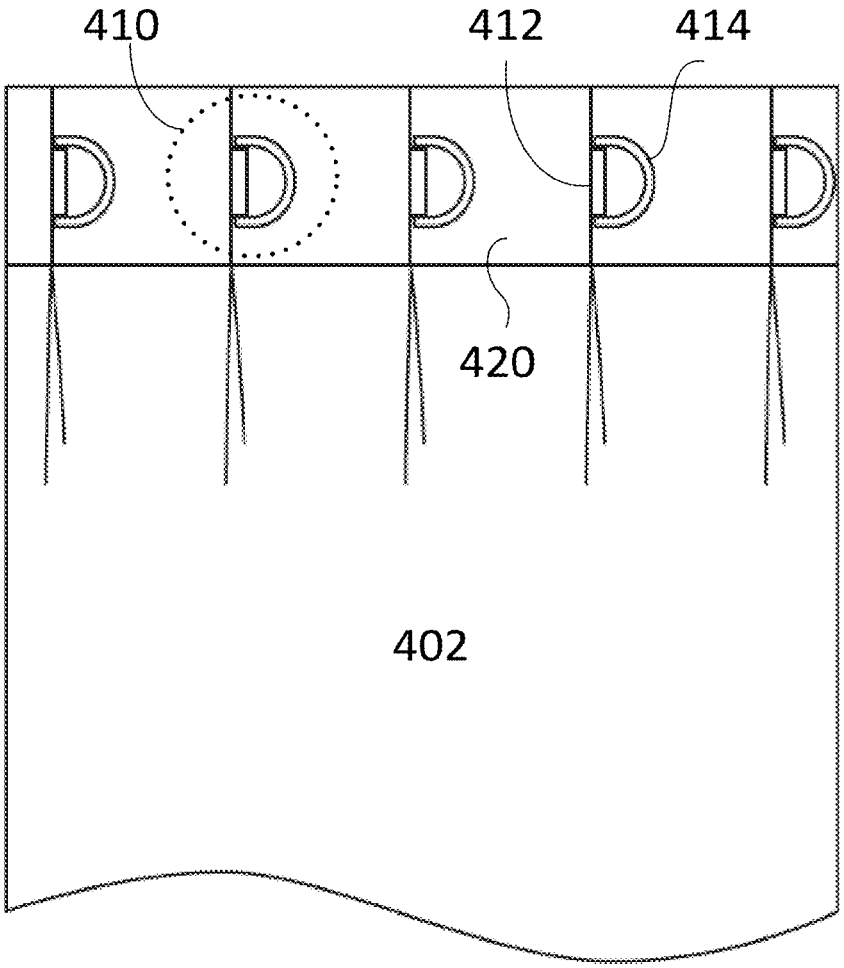
FIG. 4A illustrates a back side of a curtain panel with a plurality of fabric tabs and grommets attached to a top section of the panel according to an embodiment of the present disclosure.

FIG. 4A illustrates a back side of a curtain panel where a plurality of fabric tabs 412 and D-shaped grommets are attached to a top section 420 of the curtain panel 402 according to another embodiment of the present disclosure. The fabric tab 412 is fixedly attached to a top section 420 of the panel 402, and is made of a fabric although it can be made of any material like leather or the like. The fabric tab is designed to enclose a shaft portion 512 of the D-shaped grommet 510 as described below with reference to FIG. 5A, such that the grommet can be attached to the top section of the panel 402. Thus, each fabric tab 412 has a cylindrical hollow to accommodate the shaft portion of the grommet 510. Accordingly, the grommet is partially enclosed by the fabric tab to be affixed to the top section 420 of the panel 402. The grommet partially enclosed by the fabric tab 410 is illustrated in FIG. 4A. The fabric tab can be attached to the top section 420 of the panel 402 by various known methods. A plurality of fabric tabs with grommets partially enclosed therein are aligned to receive a curtain rod 614 as shown in FIGS. 6A.

Figure 4B:
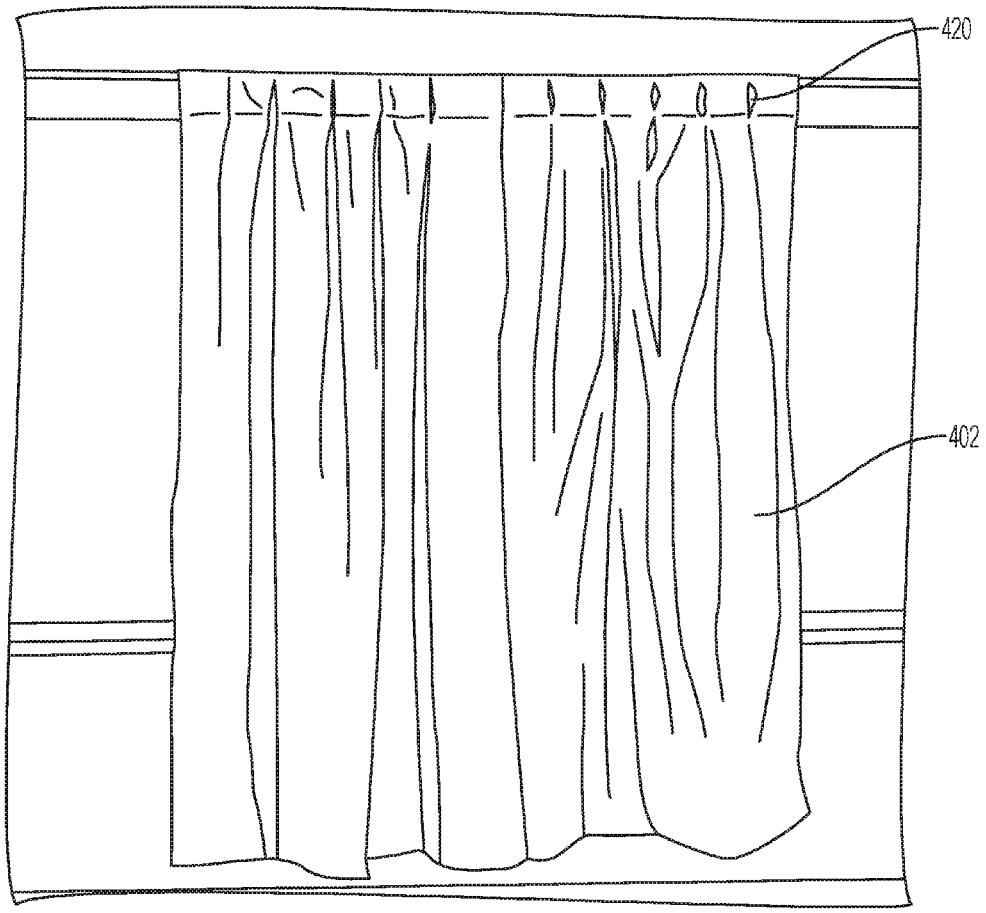
FIG. 4B illustrates a front-facing side of a curtain panel with a plurality of spaced pleats according to an embodiment of the present disclosure.

FIG. 4B illustrates a front-facing side of a curtain panel with a plurality of spaced pleats according to an embodiment of the present disclosure. FIG. 4B illustrates a front-facing side of the curtain panel 402 where a plurality of spaced pleats 422 are formed according to an exemplary embodiment of the present disclosure. The panel 402 can be formed of any flexible sheet material similar to that of the fabric tab 412, such as fabric polyester, vinyl, silk linen or the like. In one embodiment, the panel 402 can be a plain fabric with no pinch pleats formed therein. In another embodiment, the panel 402 can have a plurality of spaced pinch pleats 422 along the top section of the panel to give the panel 402 an aesthetically pleasing appearance as shown in FIG. 4B. A buckram (not shown) is a form of a liner that can be often used as a stiffener. For the purpose of the pleats 122, a buckram can be used to hold the shape of the pleats 422 in place. Optionally, the fabric tab 412 can be interlined with buckram for stability and durability.

Figure 5A:
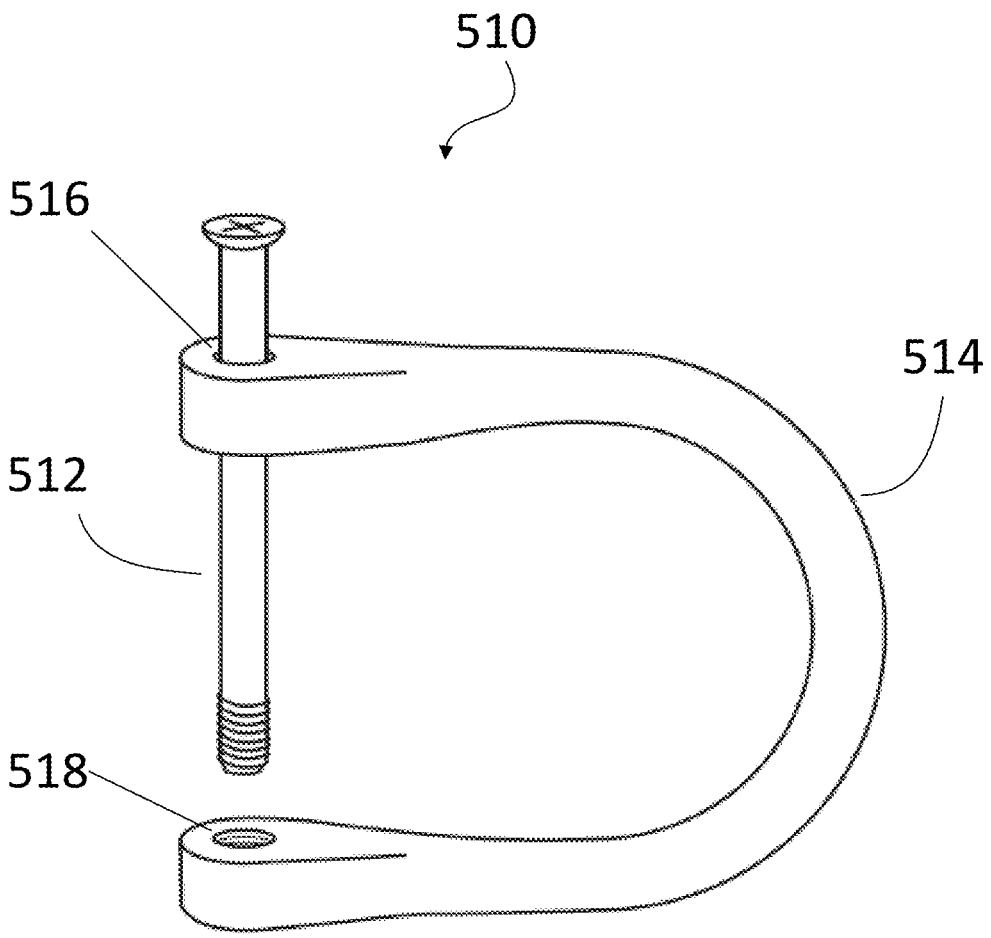
FIG. 5A illustrates a perspective view of a D-shaped grommet according to an embodiment of the present disclosure.
Figure 6A:
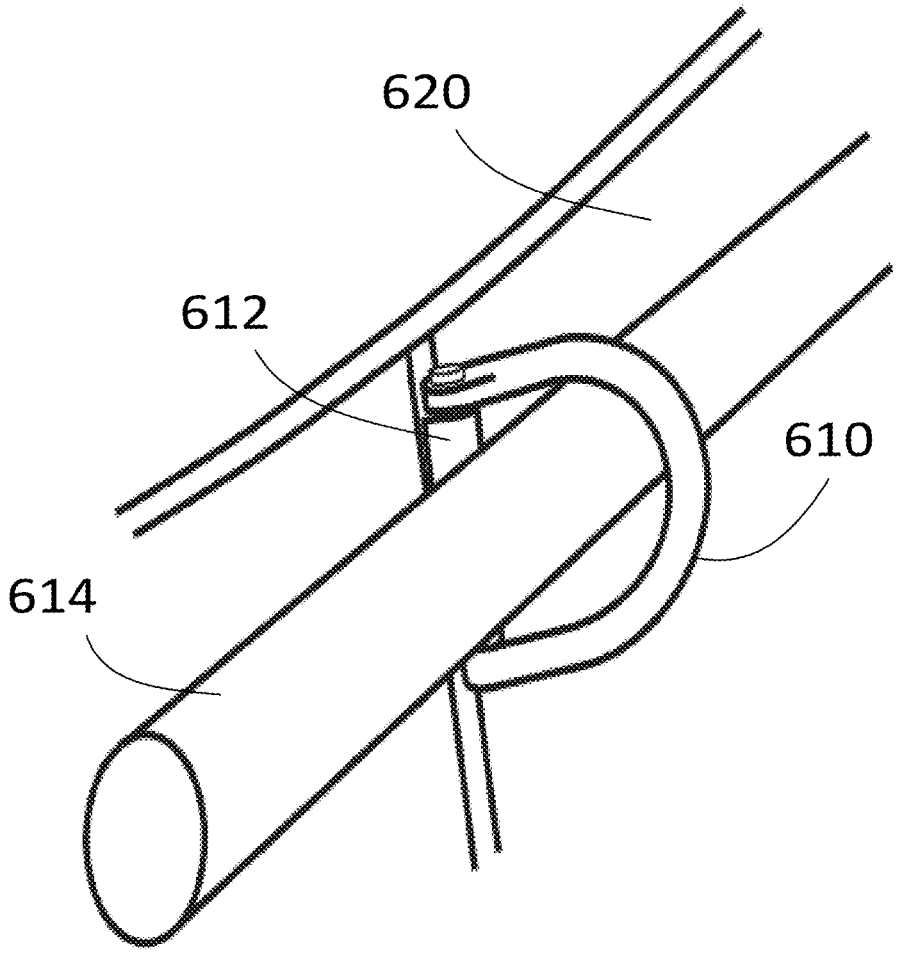
FIG. 6A illustrates a partial perspective view of a curtain panel with a grommet attached thereto by a fabric tab that is aligned to receive a rod according to an embodiment of the present disclosure.

FIG. 5A illustrates a perspective view of a D-shaped grommet according to an embodiment of the present disclosure. FIG. 5A illustrates a shaft section 512 and a body section 514 of the D-shaped grommet 510 that is designed to be attached to the top section of the back side of a curtain panel by the fabric tab according to an embodiment of the present disclosure. As stated above, the fabric tab 412 is attached to the top section of the back side of the panel 402 by sewing or other known methods. The shaft section 512 of the grommet 510 has a screw fitting on one end so that it can be fixed in place or removed from the grommet body by twisting. In an embodiment, the shaft section 512 can be manually removed using a screwdriver before the grommet is attached to the fabric tab. In order to engage the grommet to the fabric tab, the holes 516/518 formed on end portions of the grommet body are aligned with the cylindrical hollow of the fabric tab, the shaft section 512 is inserted into the cylindrical hollow through the first hole 516, and then fixed in place by another hole 518 with screws formed inside by twisting the shaft section using a screwdriver. As described above, each grommet is engaged with the fabric tabs 412 that are attached through sewing or by other means to the top section of the back side of the panel 402. Once the grommets are engaged to the fabric tab through the above-described process, they are ready to be aligned to receive a curtain rod.

Figure 5B:
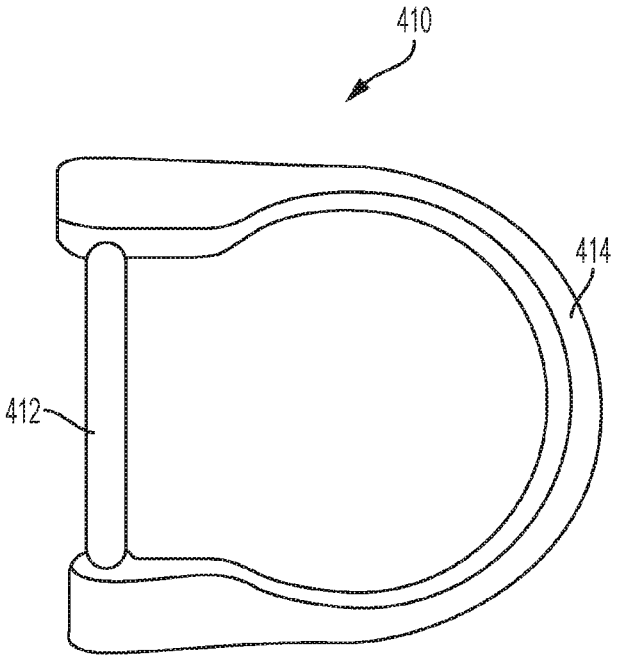
FIG. 5B is a photographic perspective view of the D-shaped grommet ("Grommet Glide Branded Grommet") according to an embodiment of the present disclosure.

FIG. 5B is a photographic side view of the D-shaped grommet according to an embodiment of the present disclosure (Grommet Glide Branded Grommet). Referring to FIGS. 4A and 5B, the fabric tabs 412 are engaged with the grommets 410 by enclosing the shaft section 412 of the grommet 410. The grommets 410 that are engaged with the fabric tabs 412 are aligned to receive a horizontal curtain rod 614 to support the panel 402. As shown in FIGS. 5A and 5B, the grommet 410 is a rigid D-shaped ring composed of a removable or non-removable shaft section 412 and a body section 414. The grommets 410 are commonly made of metal, but are not limited to metal. For example, the grommets 410 can be formed of plastic or other materials including resin, metal formed over plastic, or the like.

FIG. 6A illustrates a partial perspective view of a curtain panel with a grommet attached thereto by a fabric tab that is aligned to receive a rod according to an embodiment of the present disclosure. Referring to FIG. 6A, a perspective view of the back side of a curtain panel with a grommet 610 attached to the top section 620 of the panel by the fabric tab 612 according to an embodiment of the present disclosure. As described above, the fabric tab 612 is attached to the top section of the back side of the panel 402 as shown in FIGS. 4A and 6A. The grommet 610 is engaged with the fabric tab 612 which is attached to the top section 620 of the back side of the panel 402 as described above.

Figure 6B:
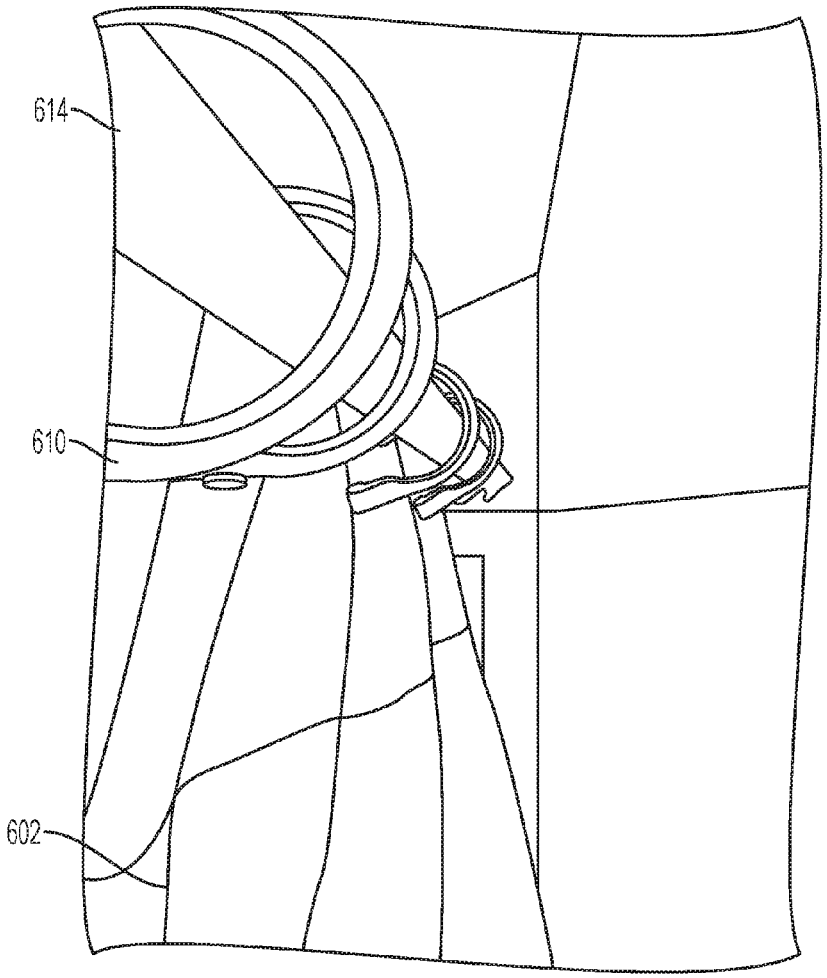
FIG. 6B is a photographic side view of a curtain panel hanging from a plurality of grommets that are aligned to receive a rod according to an embodiment of the present disclosure.

FIG. 6B is a photographic side view of a curtain panel with a plurality of grommets attached thereto by the fabric tabs to receive a rod according to an embodiment of the present disclosure. FIG. 6B shows an actual picture of the panel hanging from the grommet glide. Referring to FIG. 6B, a curtain panel 602 with grommets 610 engaged with fabric tabs is disclosed. The panel 602 is designed to be suspended from and movable along a horizontally extending curtain rod 614. The rod 614 can be attached to a wall or to a window frame above or in front of the window. The grommets 610 that are engaged with the fabric tabs can be easily aligned to receive the rod 614, and thus no drapery hooks, rings, or pins are necessary to hang the panel from the rod.

Figure 7:
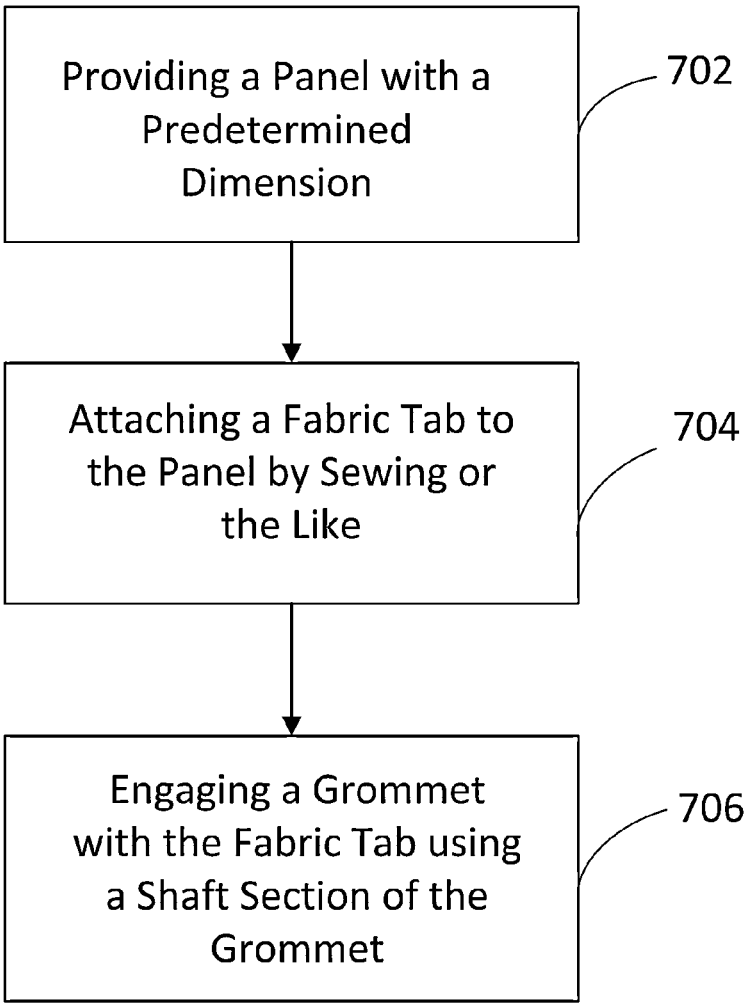
FIG. 7 is a flow chart depicting a process of manufacturing a curtain panel with grommets attached thereto by fabric tabs according to an embodiment of the present disclosure.

FIG. 7 is a flow chart depicting a process of manufacturing a curtain panel with grommets attached thereto by fabric tabs according to an embodiment of the present disclosure. Referring to FIG. 7, the manufacturing process begins at step 702 where a curtain panel with a predetermined dimension is provided. As one exemplary embodiment, the panel 402 is about 84 inches in length and 25 inches in width, but is not limited to a specific dimension. However, there are many readymade panels with different width and length, the panel 402 is not limited to a specific dimension in either width or length. The panel with fabric tabs engaged with grommets as disclosed in the present disclosure can be applied to any types of curtains such as window curtains, shower curtains, or kitchen curtains. At step 704, a fabric tab is attached to the top section of the backside of the curtain panel through sewing or by other known method so that it can accept a grommet. Each grommet is engaged with the fabric tab at step 706 by inserting the shaft section of the grommet into the cylindrical hollow of the fabric tab as described above. The inserted shaft section is fixed in place by twisting using a screwdriver, or the like.

According to the present disclosure, a curtain panel with fabric tabs engaged with grommets is configured to glide on a curtain rod for easy hanging, opening, and closing the panel. The present disclosure eliminates the need for extra hardware including drapery pins or hooks. Additionally, the disclosed curtain panel allows for easy care and smooth hanging, opening, closing, and laundering the panel without any additional mechanism, and no part of the curtain rod can be seen when installed.

It is to be understood that the present disclosure is not limited to the illustrations described and shown herein, which are deemed to be merely illustrative of the best modes of carrying out the invention, and which are susceptible to modification of form, size, arrangement of parts, and details of operation. The present disclosure is intended to encompass all such modifications which are within its spirit and scope of the invention as defined by the following claims.

What is claimed is:

1. An apparatus for hanging a household curtain including a front side and a back side opposite the front side, the apparatus comprising:

a plurality of fabric tabs affixed to a top section of the back side of the household curtain and opposite to a plurality of pleats on the top section of the front side, wherein each of the fabric tabs forms a substantially cylindrical hollow portion; and a plurality of grommets each comprising a rigid material and each comprising a substantially straight section and a curved section, the substantially straight section including a screw with threads on a first end and a screw head on a second end, the curved section including holes at each end to receive the substantially straight section, wherein one hole includes threads to engage with the threads of the first end of the substantially straight section such that the curved section is configured to removably engage with the substantially straight section forming a letter "D" shaped closed loop when engaged;

wherein the substantially straight section of each grommet engages with the cylindrical hollow portion of one of the fabric tabs by passing through the cylindrical hollow portion;

wherein the plurality of grommets are removably attached when engaged with the household curtain;

wherein the curved section of each grommet is configured to receive a curtain rod; and wherein the curtain rod and the plurality of grommets are not visible from the front side of the household curtain when the apparatus is installed.

2. The apparatus of claim 1, wherein the curved section of each grommet is configured to receive a curtain rod by passing through the "D" shaped closed loop.

3. The apparatus of claim 1, wherein the fabric tabs each comprise one of polyester, vinyl and silk linen.

4. The apparatus of claim 1, wherein the pleats are substantially evenly spaced.

5. The apparatus of claim 1, wherein the fabric tabs each comprise one of a fabric the same as the household curtain and a fabric different from the household curtain.

6. The apparatus of claim 1, wherein at least one end of the curved section is configured to be removed from the substantially straight section using a screwdriver.

7. The apparatus of claim 1, wherein one or more of the fabric tabs are interlined with a buckram.

8. The apparatus of claim 1, wherein the rigid material includes one of metal and plastic.

9. A method of manufacturing a household curtain including a front side and a back side opposite the front side, comprising the steps of:

affixing a plurality of fabric tabs to a top section of the back side of the household curtain and opposite to a plurality of pleats on the top section of the front side, wherein each of the fabric tabs forms a substantially cylindrical hollow portion; and assembling a plurality of grommets each comprising a rigid material and each comprising a substantially straight section and a curved section, the substantially straight section including a screw with threads on a first end and a screw head on a second end, the curved section including holes at each end to receive the substantially straight section, wherein one hole includes threads to engage with the threads of the first end of the substantially straight section such that the curved section is configured to removably engage with the substantially straight section forming a letter "D" shaped closed loop when engaged;

wherein the substantially straight section of each grommet engages with the cylindrical hollow portion of one of the fabric tabs by passing through the cylindrical hollow portion;

wherein the plurality of grommets are removably attached when engaged with the household curtain;

wherein the curved section of each grommet is configured to receive a curtain rod; and wherein the curtain rod and the plurality of grommets are not visible from the front side of the household curtain when the apparatus is installed.

10. The method of claim 9, wherein the curved section of each grommet is configured to receive a curtain rod by passing through the "D" shaped closed loop.

11. The method of claim 9, wherein the fabric tabs each comprise one of polyester, vinyl and silk linen.

12. The method of claim 9, wherein the pleats are substantially evenly spaced.

13. The method of claim 9, wherein the fabric tabs each comprise one of a fabric the same as the household curtain and a fabric different from the household curtain.

14. The method of claim 9, wherein the rigid material includes one of metal and plastic.

15. The method of claim 9, wherein at least one end of the curved section is configured to be removed from the substantially straight section using a screwdriver.

16. The method of claim 9, wherein one or more of the fabric tabs are interlined with a buckram.

* * * * *